US010022883B2

(12) United States Patent
Herrmann et al.

(10) Patent No.: US 10,022,883 B2
(45) Date of Patent: Jul. 17, 2018

(54) SEQUENTIAL DIE CUT AND SLITTING FOR IMPROVED COLLATION

(71) Applicant: XEROX CORPORATION, Norwalk, CT (US)

(72) Inventors: Douglas K Herrmann, Webster, NY (US); Kevin St Martin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 136 days.

(21) Appl. No.: 15/358,317

(22) Filed: Nov. 22, 2016

(65) Prior Publication Data

US 2018/0141229 A1 May 24, 2018

(51) Int. Cl.

| | |
|---|---|
| ***B26D 1/62*** | (2006.01) |
| ***B26D 7/18*** | (2006.01) |
| ***B31D 1/02*** | (2006.01) |

(52) U.S. Cl.

CPC ..... *B26D 1/626* (2013.01); *B26D 7/18* (2013.01); *B31D 1/021* (2013.01); *B31D 1/026* (2013.01); *B31D 2201/02* (2013.01)

(58) Field of Classification Search

CPC ..... B26D 1/626; B26D 7/18; B31D 1/026; B31D 1/021; B31D 2201/02

USPC ..... 83/886

See application file for complete search history.

(56) References Cited

U.S. PATENT DOCUMENTS

| | | | | | |
|---|---|---|---|---|---|
| 462,469 | A * | 11/1891 | Clark | B26D 7/18 | 83/114 |
| 3,892,901 | A * | 7/1975 | Smith | B26D 9/00 | 40/638 |
| 3,958,051 | A * | 5/1976 | Smith | B26D 9/00 | 156/152 |
| 4,671,003 | A * | 6/1987 | Vitol | G09F 3/02 | 156/289 |
| 6,090,027 | A * | 7/2000 | Brinkman | B65B 5/02 | 156/DIG. 4 |
| 6,253,819 | B1 * | 7/2001 | Frendle | B26D 3/085 | 156/518 |
| 6,464,818 | B1 * | 10/2002 | Schulze | B32B 37/22 | 156/248 |
| 7,415,916 | B2 * | 8/2008 | Lindsey, Jr. | B26D 3/085 | 257/E21.599 |
| 7,975,416 | B2 | 7/2011 | Engelby et al. | | |
| 8,074,551 | B2 * | 12/2011 | Chae | B28D 1/225 | 225/2 |
| 8,302,338 | B2 | 11/2012 | Engelby et al. | | |
| 9,475,367 | B1 | 10/2016 | Wilson, III et al. | | |
| 2008/0116284 | A1 * | 5/2008 | Gordon | G09F 3/0288 | 235/487 |
| 2010/0026738 | A1 * | 2/2010 | Saikawa | B41J 3/4075 | 347/1 |
| 2010/0218090 | A1 * | 8/2010 | Amit | G06F 17/211 | 715/247 |
| 2013/0221021 | A1 * | 8/2013 | Tani | C09J 7/38 | 221/73 |

(Continued)

*Primary Examiner* — Sean Michalski

(57) ABSTRACT

A system and process for cutting and slitting media into individualized signage members without leaving material cut from said media attached to said media includes pre-die cut openings or cut outs placed in the media based upon adhesive and liner layout of the media and cutter slitter blades used in order to create a consistent break point for slit waste.

20 Claims, 5 Drawing Sheets

(56) References Cited

U.S. PATENT DOCUMENTS

| | | | | |
|---|---|---|---|---|
| 2014/0238214 | A1* | 8/2014 | Finken | B31D 1/026 83/886 |
| 2016/0031114 | A1* | 2/2016 | DeLise, Jr. | B26D 1/205 83/341 |
| 2016/0200072 | A1* | 7/2016 | Zama | B32B 7/06 428/41.6 |

* cited by examiner

SEQUENTIAL DIE CUT AND SLITTING FOR IMPROVED COLLATION

BACKGROUND

The present disclosure relates to a process of cutting and slitting adhesive signage for store shelving, and more particularly, to an improved method for cutting and slitting sheets of adhesive signage into individualized signage members without leaving scrim.

In general, marketing signs for in-store shelving can be either an adhesive type or non-adhesive type. In U.S. Pat. No. 7,975,416 B2, a non-adhesive type marketing sign is shown that includes a free portion, a base portion and a connected portion that couples the base portion to the free portion. The base portion includes an engaging piece and a support piece. The engaging piece is coupled to the support piece of a base bend line and configured to engage with a portion of a product display structure having a price holder. Another marketing sign is shown in U.S. Pat. No. 8,302,338 constructed of sheet material. The sheet material includes a free portion, a base portion and a connecting portion that couples the base portion to the free portion. The base portion includes an engaging piece and a support piece. The engaging piece is coupled to the support piece at a base bend line and configured to engage with a portion of a product display structure having a price holder. The connecting is defined between a first connecting bend line spaced apart from a second connecting bend line by a first distance. The first connecting bend line is adjacent the support piece of the base portion and the second connecting bend line is adjacent the free portion. The first distance substantially corresponds with a top edge thickness of the price holder.

The process currently used to create adhesive signage for store shelving involves applying a PSA (pressure sensitive adhesive) tape to a paper sheet or other substrate and then printing signs on the modified substrate. The tape involves an adhesive and a backer which leads to a major problem when feeding the signage into a printer due to the uneven deformation of sheet stacks as a result of the pressure sensitive adhesive tape along the top of the sheets and none along the bottom of the sheets. The media is ~8 mils thick and the adhesive tape is ~10 mils thick leading to a total thickness of roughly 18 mils on one side of the media and 8 mils on the other. One solution to this problem is to use an additional and sacrificial tape strip along the bottom of the sheets or the sheets cannot be fed. However, this creates an additional problem in that the cost of the tape used in this process is prohibitively high and the tape strips are not optimized for high speed slitting with cross process collation need for specialized in-store applications.

A process which creates a taped media imposition on media sheets that orients the PSA (pressure sensitive adhesive) to card color bands which are imposed in a mirror image is disclosed in U.S. Pat. No. 9,475,367. This process removes the feeding problems, as well as, the need for a sacrificial tape strip.

However, in some instances, the adhesive strip construction in U.S. Pat. No. 9,475,367 can have durability issues in stores with signs falling off store shelve edges.

Multilayer substrates for making in-store signage for shelving that include a polymer lined fully backed adhesive stock can be cut into predetermined sized cards for store shelving that adds strength, but does not accommodate slitting into consistent pieces often leaving material cut from the substrates hanging onto the substrates and causes clogs and jams in a downstream collator.

Obviously, there is a need for an improved system and process for cutting and slitting polymer lined fully backed adhesive signage stock for store shelving while simultaneously eliminating material hanging from the signage stock.

SUMMARY

Accordingly, an answer to this need is disclosed herein that includes a system of pre-die cut openings placed on substrates based on their adhesive and polymer liner layout and position of slitter blades to create a consistent break point for substrate waste created by the slitter blades on the substrates. These die cut opening impositions are super imposed on the adhesive and polymer imposition to line up with slit cuts being done so that the polymer carrier and media are cleanly cut at the beginning and ending of the slit cuts to thereby cause the waste material cut from the substrates to fall cleanly from each slit before the substrates proceed into a subsequent collating operation.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
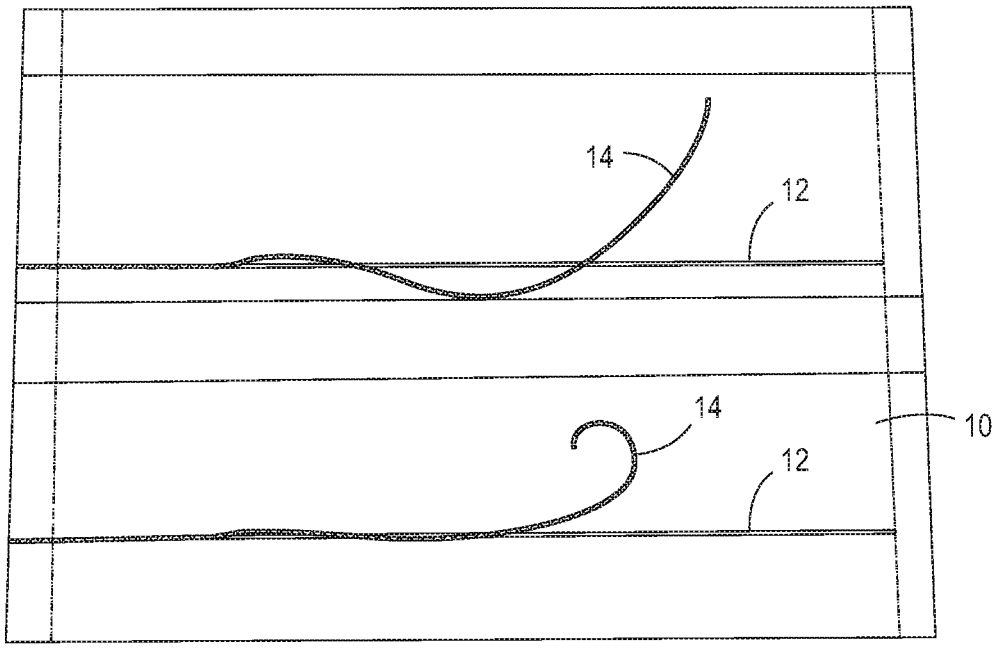
FIG. 1 is a plan view illustration of polymer lined fully backed adhesive signage media after being cut by a cutter mechanism showing waste material remaining uncut and attached to the media.

For a general understanding of the features of the disclosure, reference is made to the drawings. In the drawings, like reference numerals have been used throughout to identify identical elements.

Figure 2A:
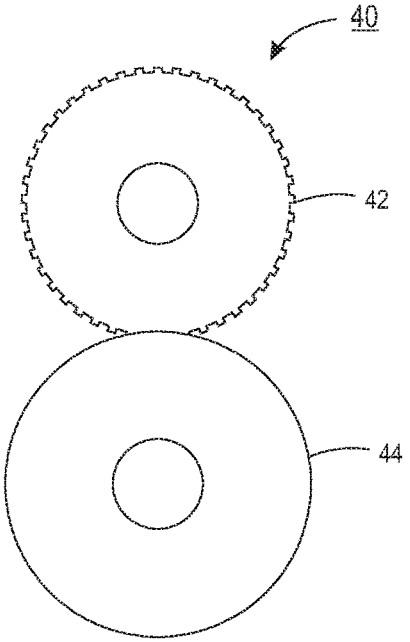
FIG. 2A is side view of a cutter with a blade that has been moved into a groove and cutting position within a mating member and in FIG. 2B the cutting blade has been moved into a non-cutting position with respect to the mating member.
Figure 2B:
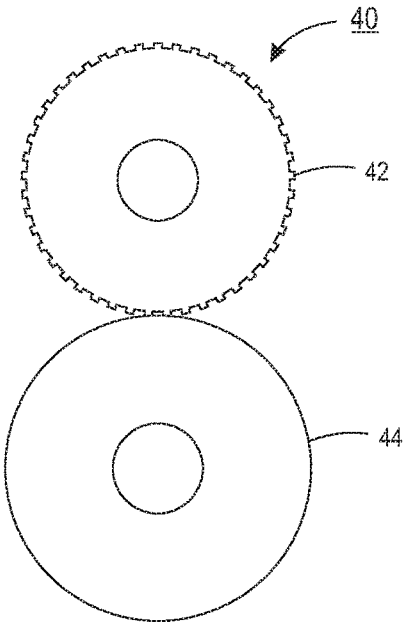
Figure 3:
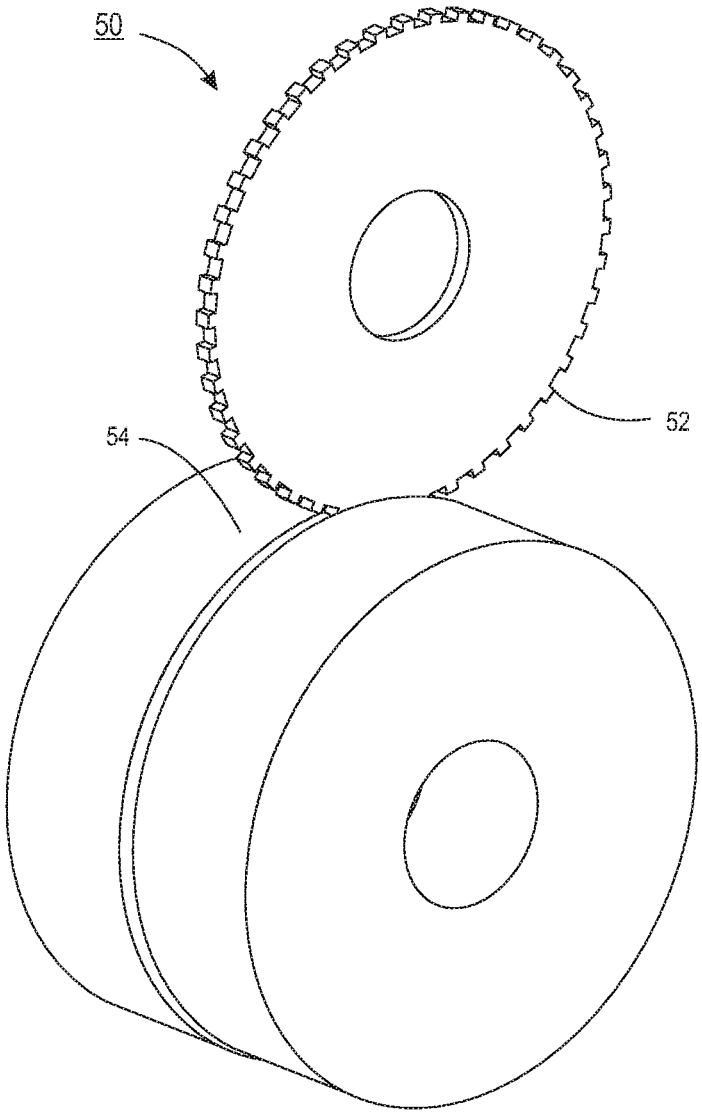
FIG. 3 is side views of a cutter with a stationary positioned rotary blade inserted into a groove and cutting position in a stationary positioned rotary mating member.

FIG. 1 is a schematic top view illustration of a multilayer substrate 10 that includes a polymer carrier that adds strength to the substrate, but does not facilitate cutting into consistent pieces needed for placement onto store shelving and often leaves unusable cut material 14 hanging from the substrate that causes clogs and jams in a downstream collator when cut into store shelving sized pieces before reaching the downstream collator. As shown in FIG. 2A, a first conventional cutter 40 includes a rotary blade 42 that has been moved into a groove in stationary rotating member 44 for engagement with substrate 10 of FIG. 1 in a lengthwise direction and is lifted away from the substrate as shown in FIG. 2B leaving slit cuts 12 in the substrate and unwanted waste material 14 hanging from the substrate. With the attached waste material 14 not releasing from substrate 10 once movable blade 42 has been lifted, an issue is created since the substrate is conveyed downstream to a second conventional cutter 50 in FIG. 3 that includes a stationary rotating blade 52 positioned to extend into a groove in mating member 54 in order to cut the substrate orthogonally and forward the cut pieces into separate bins of a downstream collator. Since the attached waste material 14 has not released from the substrate during the first dynamic cut it is delivered to the collator and can create jams in separate bins of the collator.

Figure 4:
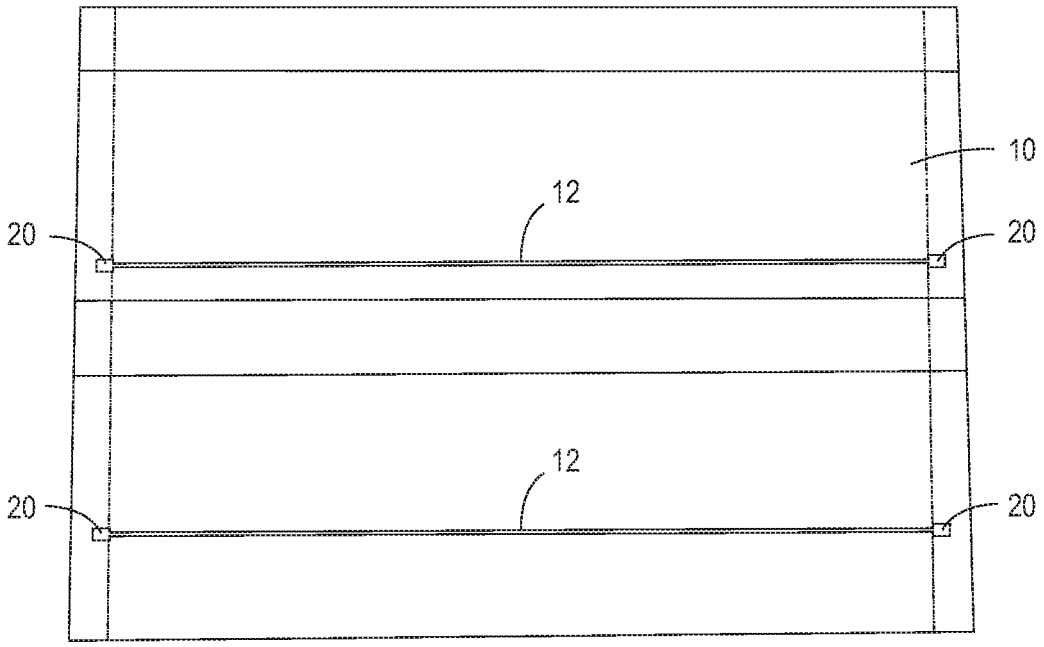
FIG. 4 is a plan view of a polymer lined fully backed adhesive signage media containing die cut chip outs after being cut by a cutter mechanism showing all slit cut waste material removed from the media.

A solution to this problem is shown in FIG. 4 that incorporates a two-step cutting method to ensure that the polymer carrier in substrate 10 is slit and the material cut from the substrate is removed effectively prior to being transported to the collation system. By placing a die cut 20 at the leading and trailing edges of the substrate based on the sign and material and adhesive imposition, slitter blades of cutter 40 will cut strips up to the point of the die cut and will provide a clean cut of substrate 10 without any attached waste material. Without this die cut system of openings waste material will continue to remain attached to the cards and moved along to the collator and cause jams in the collator. Die cut openings 20 at the lead edge and trail edge of substrate 10 facilitate accurate placement of final cut location by allowing the dynamic slit to be timed to act during the die cut. The die cuts eliminate the issue of material cut from the substrate not releasing during the first dynamic cut and simultaneously eliminates the issue of waste material attaching to the substrate.

Figure 5:
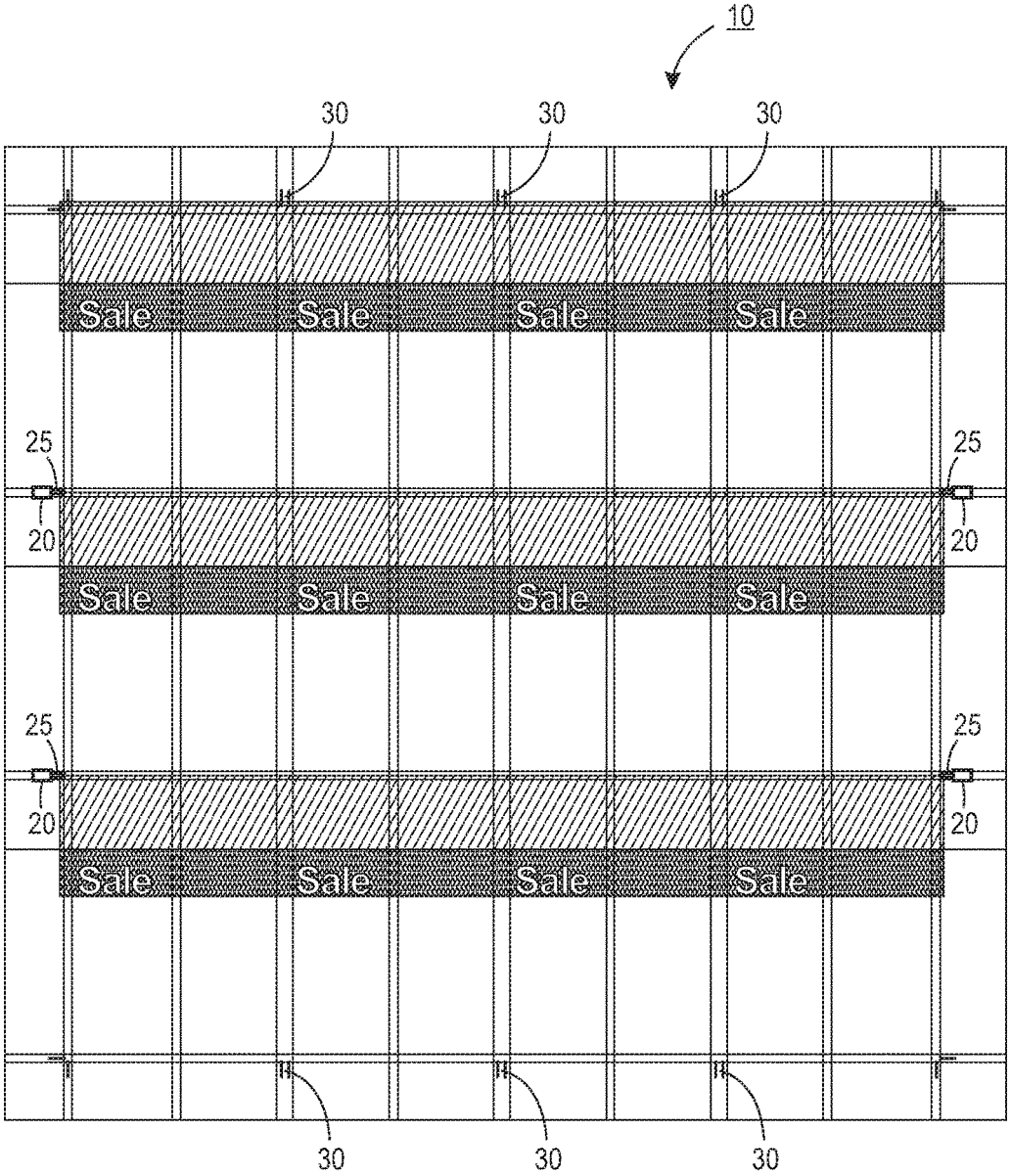
FIG. 5 is a plan view of a polymer lined fully backed adhesive signage media containing die cut openings and column and row gutter placements.

In FIG. 5, and in accordance with the present disclosure, a polymer lined fully backed substrate 10 is shown that comprises row gutters 25 for access by the first cutter 40 and column gutters 30 to be accessed by the second cutter 50. Die cuts 20 are placed at the leading and trailing edges of the substrate in order for the slitter blades of the cutter 40 to cut strips up to the point of the die cuts 20 and will facilitate a clean cut with the waste material resulting from the cut strips falling completely away from the substrate as shown in FIG. 4 and thereby avoiding jamming the collator. The die cuts provide a consistent way to cut polymer lined substrate 10 while simultaneously allowing for the use of the gutter cutter blades.

It should be understood that die cut openings 20 in substrate 10 can be of any particular shape desired as long as the material 14 resulting from slit cuts is allowed to release during the first dynamic slits of the substrate including, for example, square, circular, oval, semi-circular, rectangular, etc.

In recapitulation, a system for removing waste material from slits dynamically cut into substrates before the substrates are dynamically cut a second time and conveyed into a collator includes openings that can be die cut at the leading and trail edges of the substrates. The openings can also be made by hole punch, drilling, cutting or any other means as long as a hole is made in the substrate. Slitter blades of the first cutter will cut strips up to the point of the die cuts with the cut outs providing clean cuts thereby preventing waste material from remaining on the substrates and jamming a downstream collator.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for cleanly removing material cut from adhesive signage for store shelving, comprising:

providing multilayer substrates that include a polymer lined and fully backed adhesive layer;

providing row gutters on said multilayer substrates;

placing openings at lead and trail edges of said row gutters;

providing a first cutter for placing dynamic slits into said multilayer substrates; and using said first cutter to slit said multilayer substrates from said lead edge to said trail edge of said openings in said row gutters to thereby provide a clean slit cut without waste material being left attached to said multilayer substrates.

2. The method of claim 1, including providing column gutters on said multilayer substrates.

3. The method of claim 2, including providing a second cutter for placing slits in said column gutters using gutter cutting blades.

4. The method of claim 3, including conveying said multilayer substrates to a collator.

5. The method of claim 3, including providing slits in said substrates with said first cutter in a direction orthogonal to slits provided in said multilayer substrates by said second cutter.

6. The method of claim 1, including providing said openings as die cut and using said die cut openings to define end points of said dynamic slits.

7. The method of claim 6, wherein said die cut openings are circular in shape.

8. The method of claim 6, including placing said die cut openings into said multilayer substrates to create a consistent break point for said waste material.

9. The method of claim 1 wherein said die cut openings are rectangular in shape.

10. The method of claim 1, wherein said die cut openings are square in shape.

11. A method for removing excess material from slits cut in media, comprising:

providing multilayer media for receiving slits therein, said multilayer media including a polymer carrier and a fully lined adhesive;

providing a first cutter for cutting slits into said multilayer media; and providing openings in said multilayer media at predetermined ends of said slits so that said polymer carrier and adhesive are cleanly cut at the beginning and ending of said slits and thereby preventing media material resulting said cutting of slits into said multilayer media from hanging onto said substrates.

12. The method of claim 11, including die cutting said openings into said media.

13. The method of claim 12, including shaping said openings selected from a group consisting of squares, circles, ovals, semi-circles and rectangles.

14. The method of claim 12, including using said die cut openings as end points for said slits.

15. The method of claim 14, including providing row gutters on said multilayer media.

16. The method of claim 15, including placing said openings at lead and trail edges of said row gutters.

17. The method of claim 16, including providing including providing column gutters on said multilayer media.

18. The method of claim 17, including providing a second cutter for slitting said column gutters using gutter cutting blades.

19. The method of claim 18, including providing slits made by said first cutter orthogonal to slits made by said second cutter in said multilayer media.

20. A method for removing unwanted material from slits created in media in order to prevent jamming when said media is fed into a downstream collator, comprising:

providing multilayer media, said multilayer media including a polymer layer and adhesive layer;

providing row gutters on said multilayer media;

placing die cut openings at lead and trail edges of said row gutters;

providing a cutter for placing dynamic slits into said multilayer media; and using said cutter to slit said multilayer media up to the point of said openings and thereby cleanly remove leftover material cut from said slits.

* * * * *